United States Patent [19]

Blythe et al.

[11] Patent Number: 4,583,642

[45] Date of Patent: Apr. 22, 1986

[54] DISPENSER PACKAGE FOR A COLLECTION OF INTER-CONNECTED SEVERABLE SHEET MATERIAL AND METHOD OF DISPENSING

[75] Inventors: James E. Blythe, Williamson; Peter F. Wiseman, Canandaigua; Daniel G. Carr, Fairport, all of N.Y.

[73] Assignee: Mobil Oil Corporation, New York, N.Y.

[21] Appl. No.: 614,008

[22] Filed: May 25, 1984

[51] Int. Cl.[4] ..... B65D 79/00; B65H 35/10

[52] U.S. Cl. ..... 206/390; 206/225; 206/409; 206/820; 225/106; 229/17 S

[58] Field of Search ..... 206/225, 390, 407, 409, 206/494, 554, 820; 220/407; 225/42, 46–50, 78, 82, 106; 229/17 S, 69

[56] References Cited

U.S. PATENT DOCUMENTS

| | | | |
|---|---|---|---|
| 2,115,867 | 5/1938 | McConnel | 225/46 |
| 3,182,793 | 5/1965 | Wright | 229/17 S |
| 3,235,196 | 2/1966 | Platt | 206/225 |
| 3,718,251 | 2/1973 | Barnett | 206/409 |
| 3,826,361 | 7/1974 | Heckrodt | 206/409 |
| 3,843,017 | 10/1974 | Harrison | 225/106 |
| 4,181,218 | 1/1980 | Cox | 206/409 |
| 4,274,573 | 6/1981 | Finkelstein | 206/409 |
| 4,289,262 | 9/1981 | Finkelstein | 225/106 |
| 4,462,507 | 7/1984 | Marguilies | 206/409 |

FOREIGN PATENT DOCUMENTS

| | | | |
|---|---|---|---|
| 0709712 | 5/1965 | Canada | 225/106 |

*Primary Examiner*—George E. Lowrance
*Assistant Examiner*—Jimmy G. Foster
*Attorney, Agent, or Firm*—Alexander J. McKillop; Michael G. Gilman; James P. O'Sullivan

[57] ABSTRACT

A dispenser package for dispensing sheet material from a collection thereof said container including therein said collection and having at least one unitary multifunctional dispensing orifice wherein a first part of the orifice is in one wall of the container and a second part of the orifice is in another contiguous wall of the container, said first part of the orifice having a periphery which defines a comparatively broad area which merges into a plurality of comparatively narrow areas and said second part of the orifice having a periphery which defines a comparatively narrow area. The invention also includes methods of dispensing sheet material from within said container through said orifice.

11 Claims, 3 Drawing Figures

DISPENSER PACKAGE FOR A COLLECTION OF INTER-CONNECTED SEVERABLE SHEET MATERIAL AND METHOD OF DISPENSING

This invention relates generally to material dispensers and is more particularly concerned with a novel dispenser package including a collection of inter-connected severable sheet material.

Dispensers for rolled-up materials, such as, paper and the like are known. These dispensers suffer from certain drawbacks. They are normally employed to dispense material which either requires an expensive device to at least assist in the separation of the paper material from the roll or which requires the employment of two hands to sever the paper from the roll. Also, most known dispensers are designed for use in one particular position which give no flexibility concerning certain use environments.

In U.S. Pat. No. 4,274,573, there is described a dispenser for a coreless material wound into a hollow, cylindrical, self-supporting roll contained therein. In this structure it is necessary that the coreless wound roll be capable of revolving or rotating inside of the dispenser, so that the wound sheet material can be removed from the outside of the roll, as is usual with such wound material. The described structure has an elongated orifice in the wall of the dispenser in order to accommodate removal of sheet material from the periphery of the roll. This dispenser also has another orifice in a wall of the dispenser which is at right angles to the axis line of the roll. This orifice accommodates removal of sheet material from the center of the roll. This structure has the shortcoming of not being able to accommodate coreless rolls of sheet material which do not assume a comparatively tightly wound cylinder. Windings which are irregular in cross-section are unable to rotate within a package of this type. One example of irregular coreless windings are of the type fashioned from inter-connected ultra-thin plastic bags. Bags of this type are employed to hold grocery products which are frozen and/or which are apt to have wet external surfaces. Such a series of bags when rolled in coreless fashion, assume an oblong configuration when viewed from the end of the roll. The same is true for interconnected bags employed as liners for wastebaskets and for other containers. When employing such an irregular winding, the dispenser cannot dispense bags from its outer surface and thus, the dispenser of U.S. Pat. No. 4,274,573, has an orifice which is useless for this purpose. In addition, when employing such an irregular coreless roll, for some purposes it has been found that an orifice in a dispenser wall which is at right angles to the axis line of the coreless winding is not the best location for dispensing some bags.

In U.S. Pat. No. 4,289,262, there is described a dispenser apparatus for tearable web-like material. This patent claims a dispenser apparatus for tearable web-like material. It claims a dispenser apparatus per se without reference to the attitude of the web-like material to be placed in the container. This patent teaches that tearable web-like material can be dispensed through an orifice which has a particular configuration. The orifice must be able to accommodate at least two fingers simultaneously as they reach through the orifice to grasp the material to be dispensed. In one version, the orifice has a plurality of such zones accommodating two fingers and each zone has a plurality of slots therein. These slots converge to a sharp angle at an apex. In another version of the dispenser, the orifice has a single zone accommodating two fingers and a single slot therein where the edges of the slot converge to a sharp angle at an apex. In operation, the material to be passed through the wide zone is then forced into the apex of the slot and the web-like material forcefully severed from the remainder of the material.

It is an object of the present invention to overcome the disadvantages of the prior art and to provide a dispenser package which is simple, inexpensive and from which it is possible to dispense and separate severable material from a position best suited to the particular use environment.

SUMMARY OF THE INVENTION

The present invention concerns a dispenser package comprising in combination a dispenser container having therein a collection of inter-connected severable sheet material, said container having at least one unitary, multifunctional dispensing orifice, wherein a first part of the orifice is in one wall of the container and a second part of the orifice is in another contiguous wall of the container, said first part of the orifice having a periphery which defines a comparatively broad area which merges into a plurality of comparatively narrow areas and said second part having a periphery which defines a comparatively narrow area. The comparatively broad area of the orifice should be sufficiently large to permit at least comparatively free dispensing of the sheet material therethrough and the comparatively narrow areas are of a dimension so that when a dispensed sheet material is moved laterially into a selected narrow area from the broad area, substantial gathering of the sheet material will be effected so as to at least contribute to dispensing resistance and facilitate severance of the material. The first part of the orifice, which as indicated is in one wall of the container, merges into the second part of the orifice, which as indicated is in a contiguous wall of the container. In the first part of the orifice it is preferred that the narrow areas be two acute angles having a common side. The narrow area of the second part of the orifice can be a narrowing slot of any general configuration so long as it begins somewhat in registration with the open dimension of the first part of the orifice.

While the invention will now be described in connection with certain preferred embodiments, it will be understood that it is not intended to limit the invention to these particular embodiments. It is intented to cover all alternatives, modifications and equivalent arrangements as maybe included within the scope of the invention as defined by the appended claims.

DETAILED DESCRIPTION OF THE INVENTION

Figure 1:
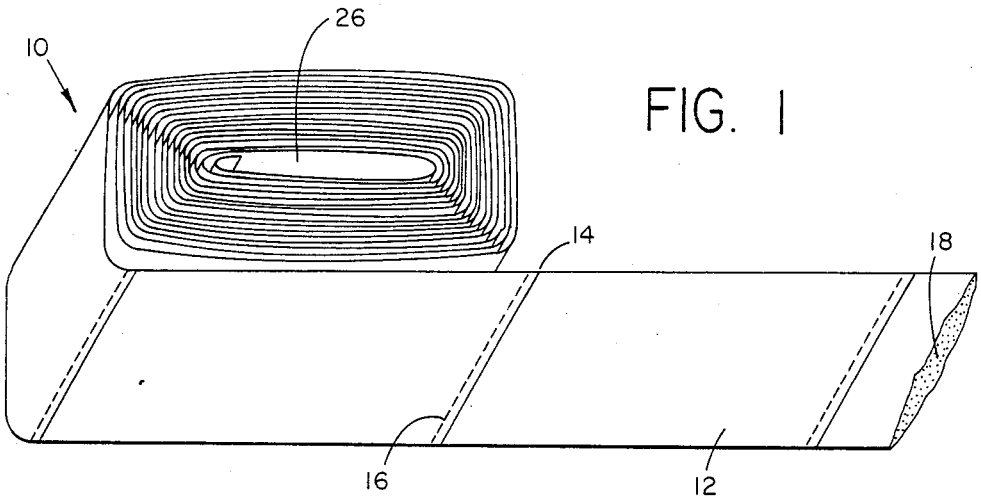
FIG. 1 shows a perspective view of a coreless roll of severable sheet material in partially unrolled condition.
Figure 2:
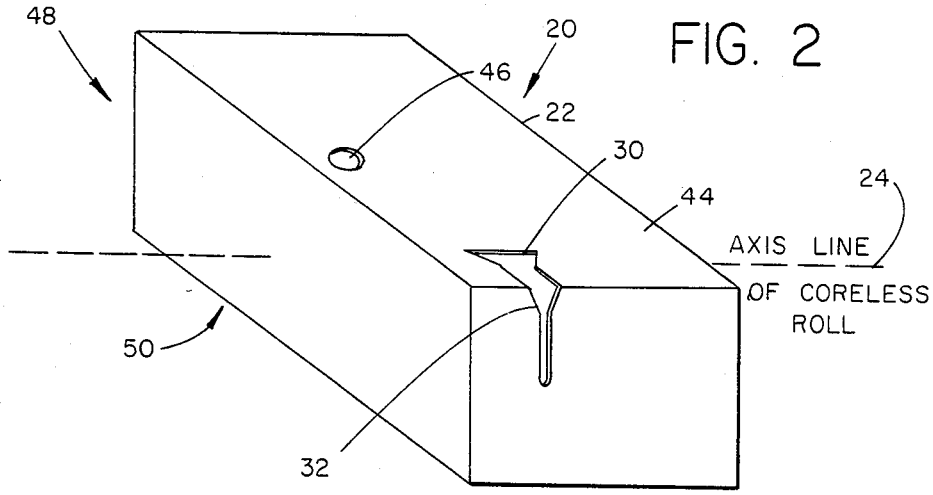
FIG. 2 is a perspective of a dispenser according to the invention, containing a coreless roll of severable material and showing one version and location of the dispenser orifice.

There can be seen in FIG. 1 a coreless roll of thermoplastic film bags 10, each bag 12 has a bottom seal 14 and, adjacent thereto, a line of perpherations 16 through the bag layers which will constitute the bag mouth opening on severance thereof. A cutaway section 18 illustrates the interior region of an individual bag. FIG. 2 shows one preferred form 20 of the dispenser package of the present invention. This dispenser comprises a box 22 made of any suitable material and formed of rectangular sides. The box blank can be made in any suitable fashion within the skill of the art, so that the entire box can be constructed of a single, foldable, sheet material with or without punchout regions for the box orifices. The box contains a coreless roll of severable material, for example, that illustrated in FIG. 1. The axis line 24 illustrates the position of the coreless roll within the box in relation to the sides of the box. The axis line 24 is parallel to the flatten coreless region 26 of FIG. 1.

Figure 3:
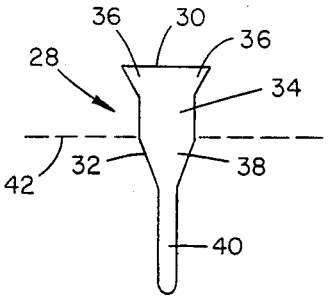
FIG. 3 is a plan view of the outline of the preferred orifice.

At one end of the dispenser package there is shown a unitary multifunctional dispenser orifice 28 shown in FIG. 3 in plan view in order to better illustrate the relative proportions of the orifice. Orifice 28 has a first part 30 in one wall of the container and a second part 32 in another contiguous wall of the container. As shown the two parts of the orifice are in planes which are at right angles to one another. The first part of the orifice has a periphery which defines a comparatively broad area 34 which merges into a plurality of comparatively narrow areas 36. The second part of the orifice 32, it will be noted, coincides dimensionally with the narrower region of the first part of the orifice 30. This region 38 in turn continues to decrease in area to acute area 40. As shown the first part of the orifice 30 has the profile shape of a wide stem funnel and the second part of the orifice 32 has the profile shape of a narrow stem funnel with its funnel mouth opening at least generally corresponding in size and being in registration with the wide stem portion of the first part of the orifice. In FIG. 3 dotted line 42 represents the end edge of the dispenser package which defines the intersection of the planes containing the first and second parts of the orifice 28. Obviously the very specific shape of the two part multifunctional orifice is for illustration purposes only and can be modified within the broad description and still be within the spirit of the same. In a version of the dispenser 20 which has a hinged lid 44 it is convenient to include an alternative circular orifice 46 in a front center edge region of said lid. This orifice can be employed as an aid to opening the cover of the dispenser for loading the dispenser with severable sheet material and/or for starting the severable sheet material through either of the orifices. Alternatively if desired the simple circular orifice can also be used as a dispensing orifice.

In one form of use of the dispenser package a convolutely wound coreless roll of the type illustrated in FIG. 1 is positioned in the dispenser box 22 and the innermost bag in the region 26 of the roll is drawn through the broad region 34 of the first part 30 of dispenser orifice 28. The size of region 34 is such that one or more bags, in tandem, can be freely dispensed through this comparatively wide region. When a bag has been extended through region 34 to a point just beyond the seal and perforation regions 14 and 16, the extended bag can then be moved laterally into any of the comparatively narrow regions 36 or 40, and with a quick snapping action severing a bag from the roll. By moving the extended bag into a comparatively narrow region, the bag becomes gathered and the increasing drag on the bag coupled with the snapping force easily separates the bag from the remainder of the roll.

By "multifunctional" is meant, the orifice accommodates free dispensing through the largest region of the orifice and gives the user the option of any one of several narrow regions for accommodating severance of individual bags.

By providing such a multifunctional orifice, the illustrated dispenser can be employed in a variety of positions to accommodate different environmental situations adjacent the dispenser container. Thus, in a supermarket at the checkout region of the store where space is at a premium, the dispenser can be positioned upright on its small area end 48, to occupy a minimum of space and any of the orifices of the package may be employed. If the use area has more available space, the dispenser can be positioned as shown on its broad area base 50 and again the user can employ any of the orifices or orifice parts, severing individual bags by snapping the bag in any one of several directions. As illustrated, the dispenser orifices are in faces of the container which are parallel to the axis line of the coreless roll. This arrangement contributes to the dispensing resistance, which aids in the severance of individual bags, particularly bags of extreme thinness, i.e. bags in the range of 0.2–0.7 mils in thickness. Bags of this type, for example, are employed as thin wet bags used to wrap ice cream containers and the like to prevent them from contacting and wetting other items in a grocery load.

For bag collection systems of larger thicknesses and larger collection sizes, for example, waste and trash type bags, the collection of bags can be folded in a zig-zag arrangement. By this is meant that one or more bags are folded back on itself along a severance line. This is repeated until the desired number of bags is collected in a zig-zag stack. Bags in such an arrangement are placed in a dispenser of the type illustrated in FIG. 2 and in this case the bags are dispensed beginning with the outermost bag.

It is to be understood that when using sheet material, particularly thermoplastic bags which are of larger gauge and overall greater area, e.g. in excess of a 5" width and a 15" inch length, then the zig-zag collection technique is preferred for dispensing within the above described dispenser.

It is to be understood that the dispensing container can be made of any material, cardboard, stiff paper, plastic, et cetera, so long as the orifice structure can withstand the force necessary to repeatedly dispense and severe individual sheets or bags from the collection. The collected sheet material when in bag form can be gusseted or ungusseted. The bags are formed from a tube by causing transverse seals to be impressed in spaced regions in the tube to form bag bottoms. Closely adjacent to each seal is a pre-weakened or perforated line permitting unit separation of said bags. The act of separation forms the bag mouth opening of each unit. These bags, fashioned into either a coreless winding or a zig-zag stack thereof can, with the aid of the described orifice be easily dispensed and separated from the collection with very little resistance.

The shape of the box is not critical so long as the orifice or orifices presents the user with a choice of severing directions. The dispenser can be square in cross section, rectangular, pyramidal, cylindrical, etc.

A method for dispensing severable sheet material within the scope of the present invention comprises providing a dispenser container including therein a collection of sheet material and providing at least one unitary, multifunctional dispensing orifice in the container. A first part of the orifice is in one wall of the container and a second part of the orifice is in another contiguous wall of the container. The first part of the orifice has a periphery which defines a comparatively broad area which merges into a plurality of comparatively narrow areas and said second part of the orifice has a periphery which defines a comparatively narrow area, said orifice being adapted for dispensing a sheet from said collection therethrough. The sheet material comprises a plurality of individually severable sheet members, said members being defined by transverse pre-weakened regions. The collection, because of its shape and position within said container cannot rotate. An end portion thereof is located adjacent said orifice so as to be comparatively easily passed therethrough. The sheet member is passed through said orifice to a point beyond said pre-weakened region. The sheet member is then pulled into a narrow area with a sudden force, sufficient to cause separation of said sheet at said pre-weakened region.

Another method for dispensing severable sheet material employing the slotted orifice disclosed herein comprises providing a dispensing container including therein a coreless convoluted winding of sheet material; providing at least one unitary multifunctional dispensing orifice in said container for dispensing said sheet material therethrough, wherein a first part of the orifice is in one wall of the container and a second part of the orifice is in another contiguous wall of the container, said first part of the orifice having a periphery which defines a comparatively broad area which merges into a plurality of comparatively narrow areas and said second part of the orifice having a periphery which defines a comparatively narrow area; said sheet material comprising a plurality of individually severable sheet materials, said members being defined by transverse pre-weakened regions, said winding being positioned within said container so that it cannot rotate therein, and an end portion thereof is located adjacent said orifice so that the inner most sheet member is positioned so as to be comparatively easily passed therethrough; passing said inner most sheet member through said orifice to a point just beyond said pre-weakened region, moving said sheet member into any of the narrow areas and pulling said member with a sudden force sufficient to cause separation of said sheet at said pre-weakened region.

When the collection of items are bags, it is not important or in any way critical to the invention how or in what relationship each bag is associated with one another. They may be severably associated, top-to-bottom, top-to-top, bottom-to-bottom, side-to-side, et cetera. It is also to be understood that the dispensing package of the present invention can be employed for certain paper or foil products fashioned in a coreless winding or zig-zag collection. For example, ordinary toilet tissue is fashioned with a central heavy cardboard core about which the toilet tissue is convolutely wound. This is to permit the toilet tissue to be dispensed from the periphery of the roll by tearing across pre-weakened, perforated regions while the roll is rotated from a central axle. In accordance with the present invention, ordinary toilet tissue can be rolled without a core and dispensed from the center of the core or zig-zag collected and dispensed from the top of the collection through a dispensing container of the type described herein.

In the dispensing of one or more members of the coreless roll, and in order to assist the user, indicia of some type can be printed or impressed into the surface of the severable material which will show the user that the perforated or pre-weakened region as extended beyond the comparatively narrow gathering area for severance of the sheet material. This will avoid an attempt at severing a bag or sheet before the pre-weakened region has been extended beyond the narrow gathering area.

Concerning the pre-weakened regions of the coreless roll, a preferred technique is the use of a line of perforations. The frequency of perforations should be such as to permit unit detachment from the roll without the danger of detaching a unit prematurely so that a succeeding unit would not partially extend from the dispenser. In a preferred pre-weakened region, a cut in the film or bag in line with the line of perforations will facilitate unit detachment. This cut or severance can be from one or both outer edges of each unit extending inwardly some distance to the beginning of the perforations. For example, in a sheet or bag unit, 8″ wide, the cut or cuts would be from about 0.5–1.5″ in length and in line with the line of perforations which continue across the unit. During dispensing, the cut or slit will tend to cause part of the unit to drag or resist passage through the narrow region of the orifice with the result that detachment will be facilitated.

What is claimed is:

1. A dispenser package comprising in combination a dispensing container having therein a collection of inter-connected severable sheet material, said container having at least one unitary multi-functional dispensing orifice, said orifice having an intercommunicating first part and second part, the first part is in one wall of the container and the second part is in another contiguous wall of the container, said first part having a periphery which defines a comparatively broad area said first part periphery also defines a plurality of comparatively narrow areas, said first part periphery narrowing and merging with said second part, said second part also having a periphery which defines an area narrower than the region of merging and being remote from all other areas.

2. The dispenser of claim 1 wherein said comparatively broad area is sufficiently large to permit at least comparatively free dispensing of said sheet material therethrough and said comparatively narrow areas are of a dimension so that when a dispensed sheet member is moved laterally into a selected one from said broad area, substantial gathering of said sheet material will be affected so as to at least contribute to dispensing resistance and facilitate severance of said material.

3. The dispenser package of claim 2 wherein said narrow areas are two acute angles having one common side.

4. The dispenser package of claim 3 wherein said first part of the orifice has a profile shape of a wide stem funnel and said second part of the orifice has a profile shape of a narrow stem funnel with its funnel mouth opening at least generally corresponding in size and being in registration with said wide stem portion of said first part of the orifice.

5. The dispenser package of claim 2 wherein said severable sheet material are thermoplastic bags.

6. The dispenser of claim 5 wherein said bags are severable at transverse perforations between bags.

7. The dispenser of claim 6 wherein said bags are collected in a coreless convoluted winding thereof.

8. The dispenser of claim 7 wherein said coreless winding has a comparatively large diameter and a comparatively small diameter in the same plane, which winding, when in position in said container, assumes an oval shape with the center thereof being of such a size and shape so as to permit pay-out of the inner most bag through said orifice.

9. The dispenser of claim 8 wherein said orifice is in container walls which are parallel to the axis-line of said winding.

10. A method for dispensing severable sheet material comprising providing a dispenser container including therein a collection of sheet material and providing at least one unitary, multi-functional dispensing orifice in the container, said orifice having an intercommunicating first part and second part, the first part being in one wall of the container and the second part being in another contiguous wall of the container, said first part having a periphery which defines a comparatively broad area, said first part periphery also defines a plurality of comparatively narrow areas, said first part periphery narrowing and merging with said second part, said second part having a periphery which also defines an area narrower than the region of merging and being remote from all other areas; said sheet material comprising a plurality of individually severable sheet materials, said members being defined by transverse pre-weakened regions, said collection, because of its shape and position within said container not being rotatable, said collection having an end portion located adjacent said orifice so as to be comparatively easily pulled therethrough by two fingers, pulling a sheet member through said orifice to a point beyond said pre-weakened region and pulling the sheet member into a narrow area with a sudden force sufficient to cause separation of said sheet at said pre-weakened region.

11. A method for dispensing severable sheet material comprising providing a dispensing container including therein a coreless convoluted winding of sheet material, providing at least one unitary multi-functional dispensing orifice in said container for dispensing said sheet material therethrough, said orifice having an intercommunicating first part and second part, the first part being in one wall of the container and the second part being in another contiguous wall of the container, said first part having a periphery which defines a comparatively broad area, said first part periphery also defining a plurality of comparatively narrow areas, said first part periphery narrowing and merging with said second part, said second part having a periphery which also defines an area narrower than the region of merging and being remote from all other areas; said sheet material comprising individually severable sheet materials, said members being defined by transverse pre-weakened regions, said winding being of a shape and being so positioned within said container so that it cannot rotate therein, and an end portion thereof is located adjacent said orifice so that the innermost sheet member thereof is positioned so as to be comparatively easily pulled through said comparatively broad area; pulling said innermost sheet member through said broad area to a point just beyond said pre-weakened region, moving said sheet member into any of the narrow areas and pulling said member with a sudden force sufficient to cause separation of said sheet at said pre-weakened region.

* * * * *